US007802527B2

(12) United States Patent
Dong

(10) Patent No.: US 7,802,527 B2
(45) Date of Patent: Sep. 28, 2010

(54) PALLET

(75) Inventor: Jane Dong, Seattle, WA (US)

(73) Assignee: XM International, Inc., Hackensack, NJ (US)

( * ) Notice: Subject to any disclaimer, the term of this patent is extended or adjusted under 35 U.S.C. 154(b) by 288 days.

(21) Appl. No.: 11/638,263

(22) Filed: Dec. 12, 2006

(65) Prior Publication Data

US 2007/0283857 A1 Dec. 13, 2007

Related U.S. Application Data

(60) Provisional application No. 60/838,093, filed on Aug. 16, 2006.

(30) Foreign Application Priority Data

Jun. 12, 2006 (CN) ..... 2006 3 0037600

(51) Int. Cl.
*B65D 19/12* (2006.01)

(52) U.S. Cl. ..... 108/56.1; 108/54.1

(58) Field of Classification Search ..... 403/292; 108/56.1, 57.1, 54.1, 57.26, 64, 65
See application file for complete search history.

(56) References Cited

U.S. PATENT DOCUMENTS 2,520,221 A * 8/1950 Ponty ..... 403/7
D221,636 S 8/1971 Moses
4,675,929 A 6/1987 Santo
4,694,962 A * 9/1987 Taub ..... 206/600
5,105,746 A * 4/1992 Reynolds ..... 108/56.1
5,267,516 A 12/1993 Abrahamson et al.
5,351,627 A 10/1994 Junaedi
D357,108 S 4/1995 Hutchison
RE35,006 E * 8/1995 Ripley et al. ..... 47/66
5,809,905 A 9/1998 John et al.
5,860,369 A 1/1999 John et al.
5,887,529 A 3/1999 John et al.
D422,768 S 4/2000 Gunn
D422,769 S 4/2000 Schmitt
D435,953 S 1/2001 Lux, Jr.
D447,310 S 8/2001 Pope et al.

(Continued)

FOREIGN PATENT DOCUMENTS

ES 2255394 6/2006

(Continued)

*Primary Examiner*—José V Chen
*Assistant Examiner*—Matthew W Ing
(74) *Attorney, Agent, or Firm*—Brandon N. Sklar, Esq.; Kaye Scholer LLP

(57) ABSTRACT

In one example, a pallet is disclosed comprising a first pallet comprising a first side wall. The first wall has a length and a first groove lying in a plane and extending along the entire length. A second pallet comprising a second side wall is adjacent to the first side wall. The second side wall has a second length and a second groove lying in the plane and extending along the entire second length. The second groove faces the first groove and is aligned with the first groove in the plane, along the entire first and second lengths. A connecting member is within the aligned first and second grooves to connect the first and second pallets. Two unit, four unit, and larger pallets may be made. A method of using such pallets is also described.

21 Claims, 15 Drawing Sheets

U.S. PATENT DOCUMENTS

| | | | | |
|---|---|---|---|---|
| D450,906 | S | 11/2001 | Schepers | |
| D452,057 | S | 12/2001 | French et al. | |
| 6,401,309 | B1 * | 6/2002 | Yang | 24/130 |
| D495,460 | S | 8/2004 | Apps et al. | |

FOREIGN PATENT DOCUMENTS

| | | |
|---|---|---|
| ES | 2255827 | 7/2006 |
| FR | 2568856 | 2/1986 |
| FR | 2585671 | 2/1987 |

* cited by examiner

PALLET

The present application claims the benefit of U.S. Provisional Patent Application No. 60/838,093, which was filed on Aug. 16, 2006, is assigned to the assignee of the present invention, and is incorporated by reference, herein.

FIELD OF THE INVENTION

A pallet for supporting objects and more particularly, a pallet that is readily formed from subpallets.

BACKGROUND OF THE INVENTION

It is common to move products, boxes of products, and other objects supported on pallets by a forklift or a handlift The products may be strapped to the pallet. The products or boxes of the products may be wrapped in plastic wrap, as well. Pallets supporting products may be shipped in containers to customers. A typical pallet may be 40 inches by 48 inches (1.0 meters by 1.2 meters), for example. A pallet of products may also be displayed on store floors.

However, a store or other such purchaser might not want a full pallet of products. In addition, a typical 40 inch by 48 inch (1.0 meter by 1.2 meter) pallet may be too big to display in certain stores. It may also be necessary to remove particular ones of the products, which might not be readily accessible when stacked on a full size pallet. Fewer products than would typically be provided on a pallet may be packaged in a corrugated cardboard box which may then be moved by a pallet for shipping, but this requires extra handling and storage materials.

SUMMARY OF THE INVENTION

In accordance with one embodiment of the invention, a pallet is disclosed comprising a first pallet comprising a first side wall. The first side wall has a length and a first groove lying in a plane and extending along the entire length. A second pallet is provided comprising a second side wall adjacent to the first side wall The second side wall has a second length and a second groove lying in the plane and extending along the entire second length. The second groove faces the first groove and is aligned with the first groove in the plane, along the entire first and second lengths. A connecting member is within the aligned first and second grooves, connecting the first and second pallets to each other. The plane may be a horizontal plane. The connecting member may be a horizontally extending plate, such as a single flat plate. The single flat plate may have the same length as the first and second lengths. A member, such as a string or rope, may be coupled to the plate and extend out of the groove, to facilitate removal of the plate. A clamp may also be provided to secure adjacent pallets to each other. The first and second side walls may be compressible by the weight of sufficient objects on the respective pallet, to bear against the connecting member.

A third pallet and a fourth pallet may also be provided. The third pallet comprises a third side wall having a third length and a third groove lying in the plane and extending along the entire third length. The fourth pallet comprises a fourth side wall adjacent to the third side wall. The fourth side wall has a fourth length and a fourth groove lying in the plane and extending along the entire fourth length. The third groove faces the fourth groove and is aligned with the fourth groove along the third and fourth lengths. The third and fourth pallets are adjacent to the first and second pallets such that the first and third grooves and the second and fourth grooves are aligned in the same plane. The connecting member is within the aligned first, second, third, and fourth grooves, to connect the first, second, third and fourth pallets.

In accordance with another embodiment, a pallet is provided comprising a first pallet comprising a first side wall. The side wall has a first horizontal groove extending at least half way along the side wall. A second pallet is provided comprising a second side wall adjacent to the first side wall. The second side wall has a second length and a second horizontal groove extending at least half way along the second side wall. The second groove faces the first groove and is aligned with the first groove along the first and second lengths. A single flat plate is within the aligned first and second grooves to connect the first and second pallets. The plate has a third length extending at least half way along either or both of the first and second side walls.

A third pallet and a fourth pallet may also be provided. The third pallet comprises a third side wall. The third side wall has a third groove lying in the plane and extending along the entire third side wall. The fourth pallet comprises a fourth side wall that is adjacent to the third side wall The fourth side wall has a fourth groove lying in the plane and extending along the entire fourth side wall. The third groove faces the fourth groove and is aligned with the fourth groove along the third and fourth side walls. The first and third grooves and the second and fourth grooves are aligned in the same plane. The connecting member is within the aligned first, second, third, and fourth grooves to connect the first, second, third, and fourth pallets.

In accordance with another embodiment of the invention, a method of using a pallet comprises positioning a first pallet comprising a first side wall having a length and a first groove extending at least halfway along the first length with a second pallet comprising a second side wall having a second length and second groove extending at least halfway along the second length, to align the first and second grooves. The method further comprises inserting a connecting member into the aligned first and second grooves, at least halfway along either or both of the first and second side walls, to connect the first pallet to the second pallet, and moving the connected first and second pallets by a forklift to a second location.

The method may also comprise loading at least the first pallet with a load, prior to positioning the first and second pallets. The method may also comprise securing the first load to the first pallet. The method may further comprise wrapping the load on the first pallet with plastic. The method may further comprise loading the first pallet with a first load, loading the second pallet with a second load, and wrapping the secured first and second loads to each other with plastic. The method may also further comprise removing the connecting member at the second location and moving the first pallet to a third location. The method may further comprise loading the first pallet with a first load comprising a first product and loading the second pallet with a second load comprising a second product different than the first product.

The method may further comprise positioning a third pallet comprising a third side wall having a third groove and a fourth pallet comprising a fourth side wall having a fourth groove with respect to the first and second pallets such that the third and fourth side walls are adjacent, the third groove and the fourth groove are aligned with each other, and the third and fourth grooves are aligned with the first and second grooves.

The method further comprises inserting the connecting member into the aligned third, fourth, first, and second grooves.

DESCRIPTION OF A PREFERRED EMBODIMENT

Figure 1:
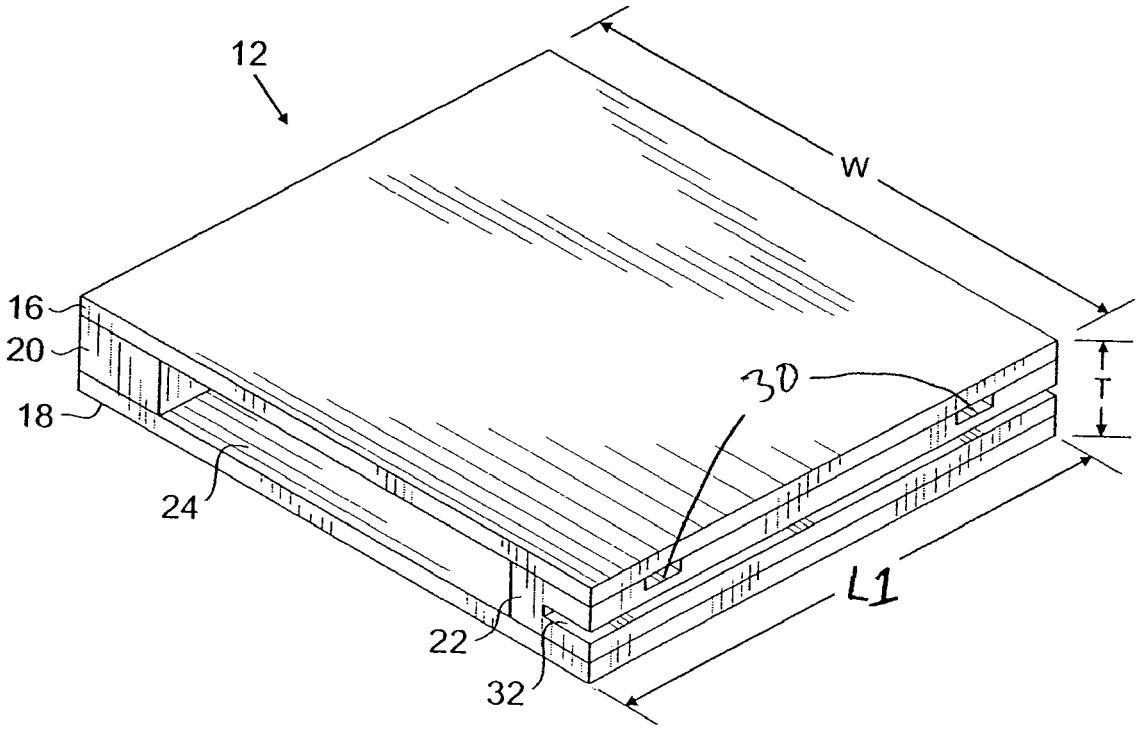
FIG. 1 is a perspective view of an example of a subpallet 12 used in embodiments of the present invention.
Figure 2:
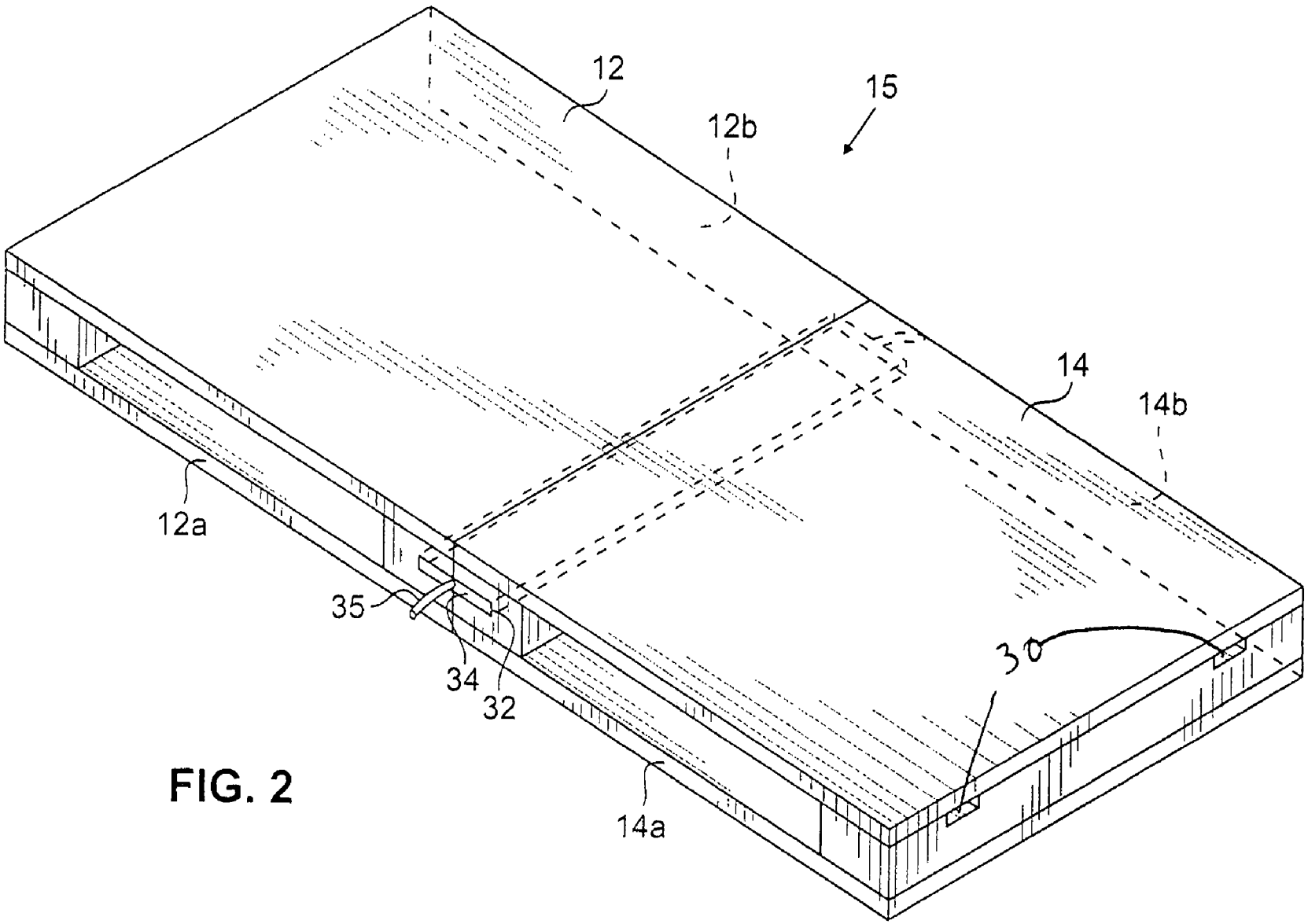
FIG. 2 is a perspective view of two subpallets coupled to each another by a connecting plate, to form a two unit pallet, in accordance with an embodiment of the invention.
Figure 2A:
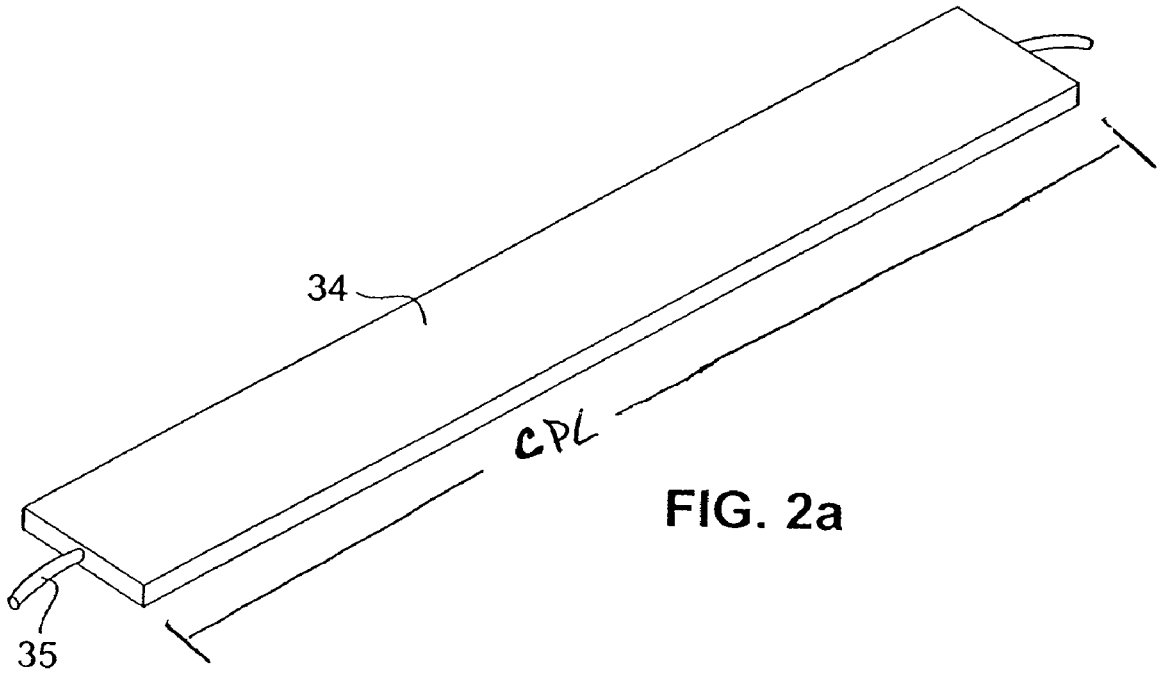
FIG. 2*a* is a perspective view of an example of the connecting plate of FIG. 2.
Figure 3:
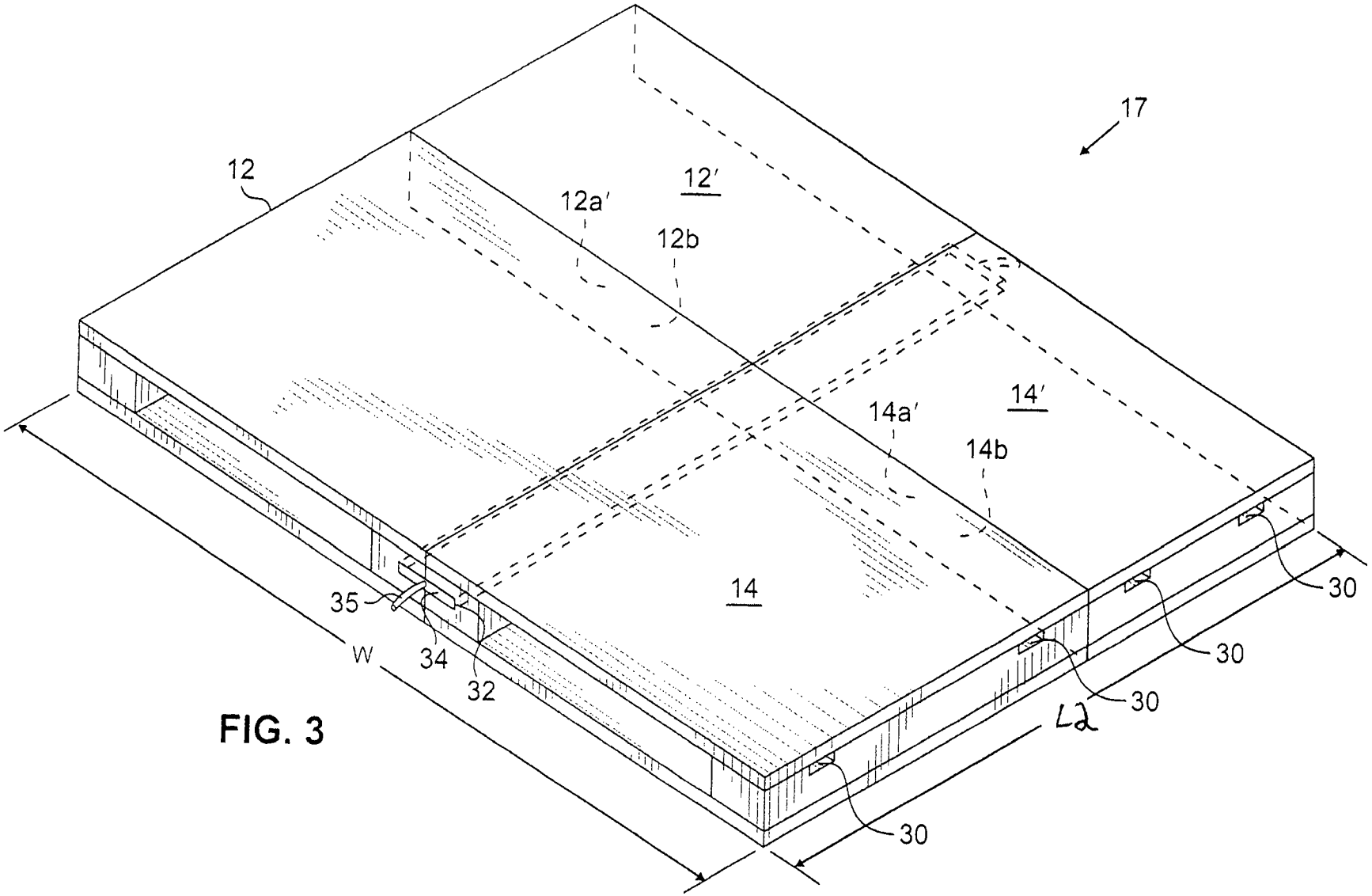
FIG. 3 is a perspective view of four subpallets coupled to each other by the connecting plate to form a four unit pallet, in accordance with an embodiment of the invention.
Figure 4:
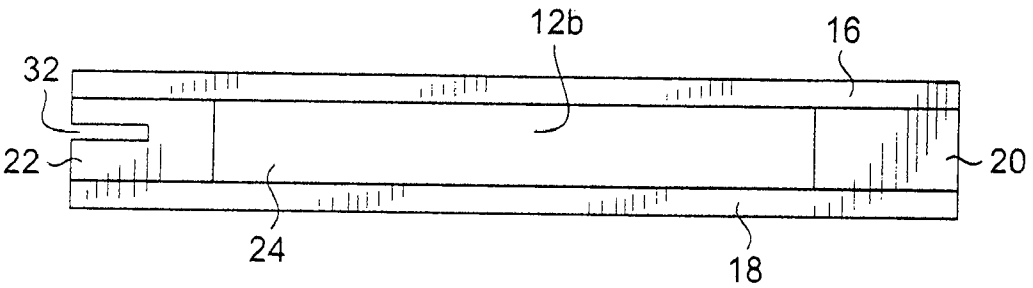
FIG. 4 is a rear view of the subpallet of FIG. 1.

FIG. 1 is a perspective view of a subpallet 12 that may be used in embodiments of the present invention. FIG. 2 is a perspective view of two subpallets 12, 14 coupled to each another by a connecting plate 34, to form a two unit master pallet 15, in accordance with an embodiment of the invention. FIG. 2*a* is a perspective view of an example of the connecting plate 34 of FIG. 2, having a length CPL. FIG. 3 is a perspective view of four subpallets 12, 14, 12', 14' coupled to each other by the connecting plate 34 to form a four unit master pallet 17, in accordance with an embodiment of the invention. FIG. 4 is a rear view of the subpallet 12 of FIG. 1.

Figure 5:
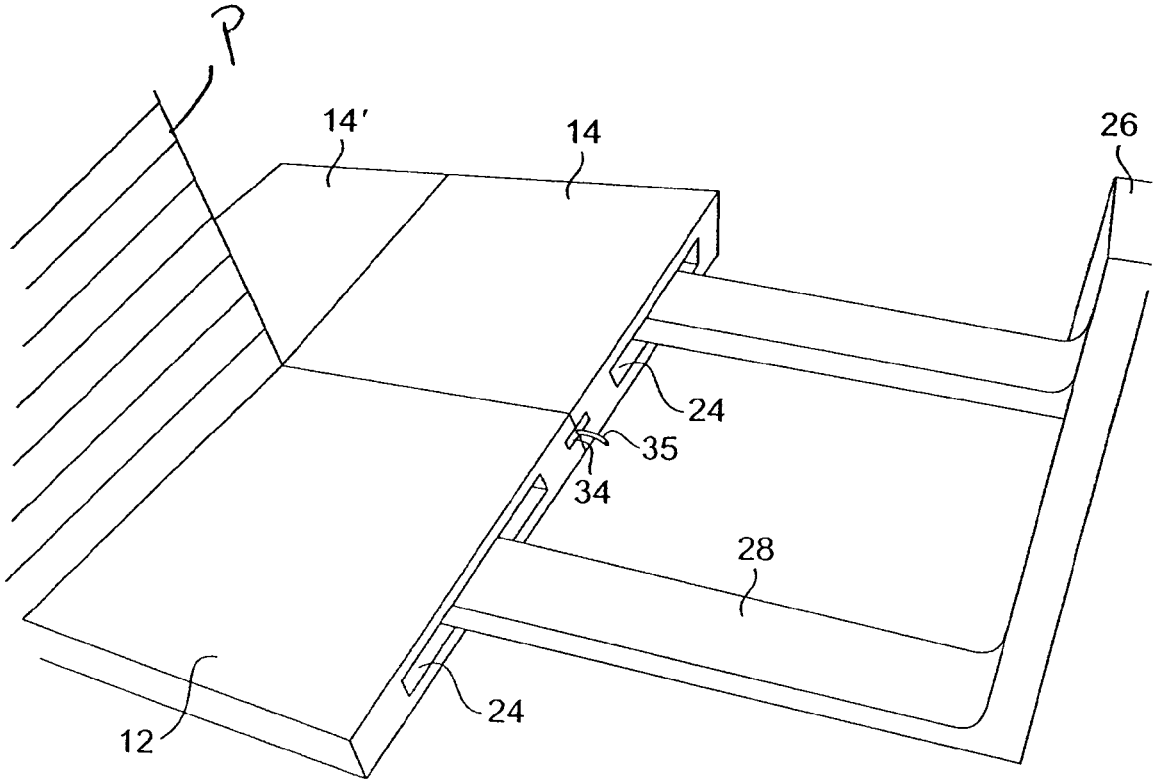
FIG. 5 is a perspective view of the four unit pallet of FIG. 3 being engaged by a forklift.

The subpallet 12 comprises an upper surface 16, which in this example comprises a supporting plate 16, and a base or lower surface 18, which in this example comprises a plate 18, as shown in FIGS. 1 and 4, for example. The supporting plate 16 is connected to the base plate 18 by rectangular blocks 20, 22, which are positioned to form a space 24 to receive one or more forklift or handlift blades 28, as shown in FIG. 5, for example. In this example, each subpallet 12, 14, 12', 14' is the same as or is a mirror image of the subpallet 12 of FIG. 1.

Figure 6:
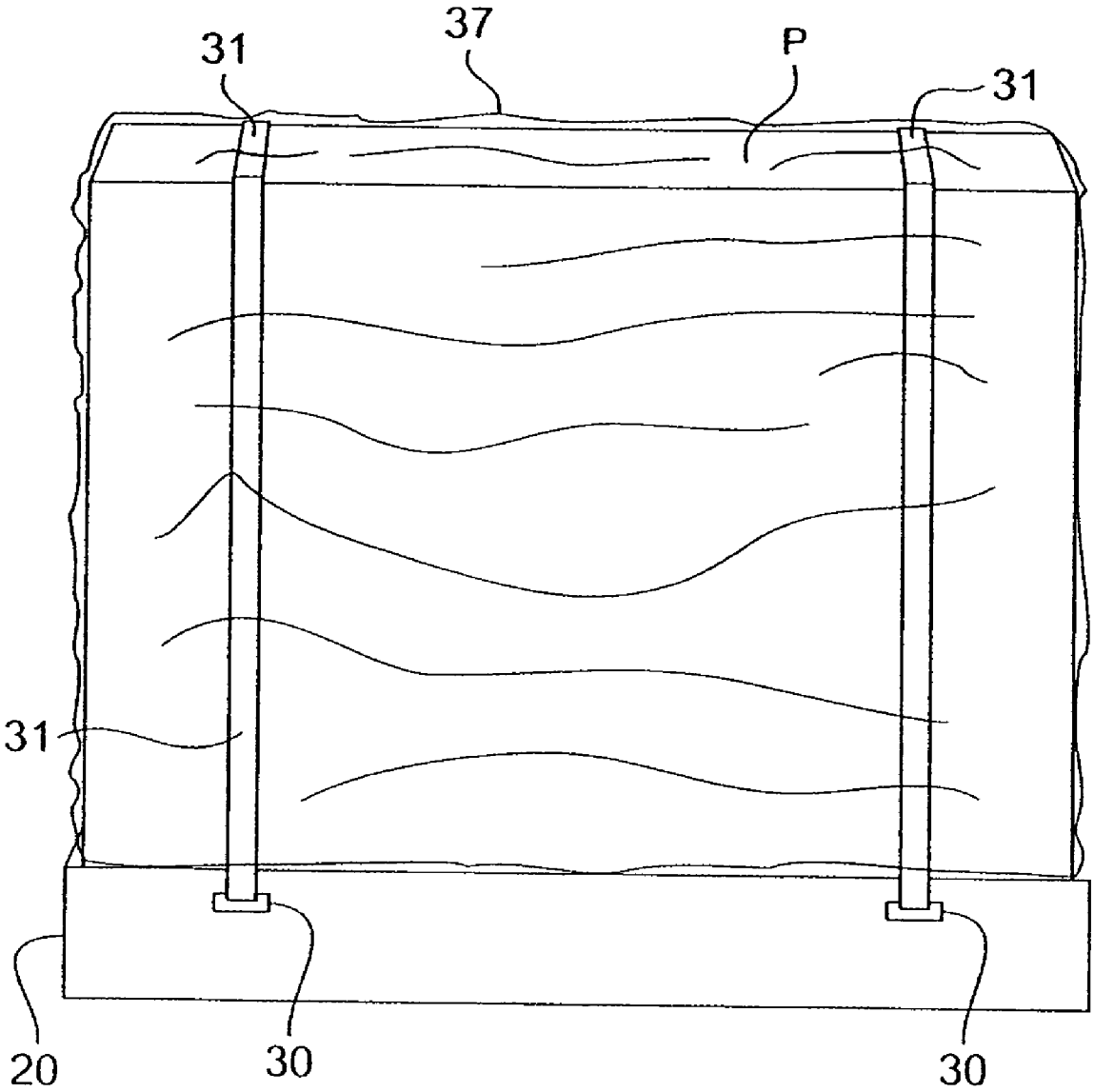
FIG. 6 is a front perspective view of products strapped to a sub pallet and wrapped in plastic.
Figure 8:
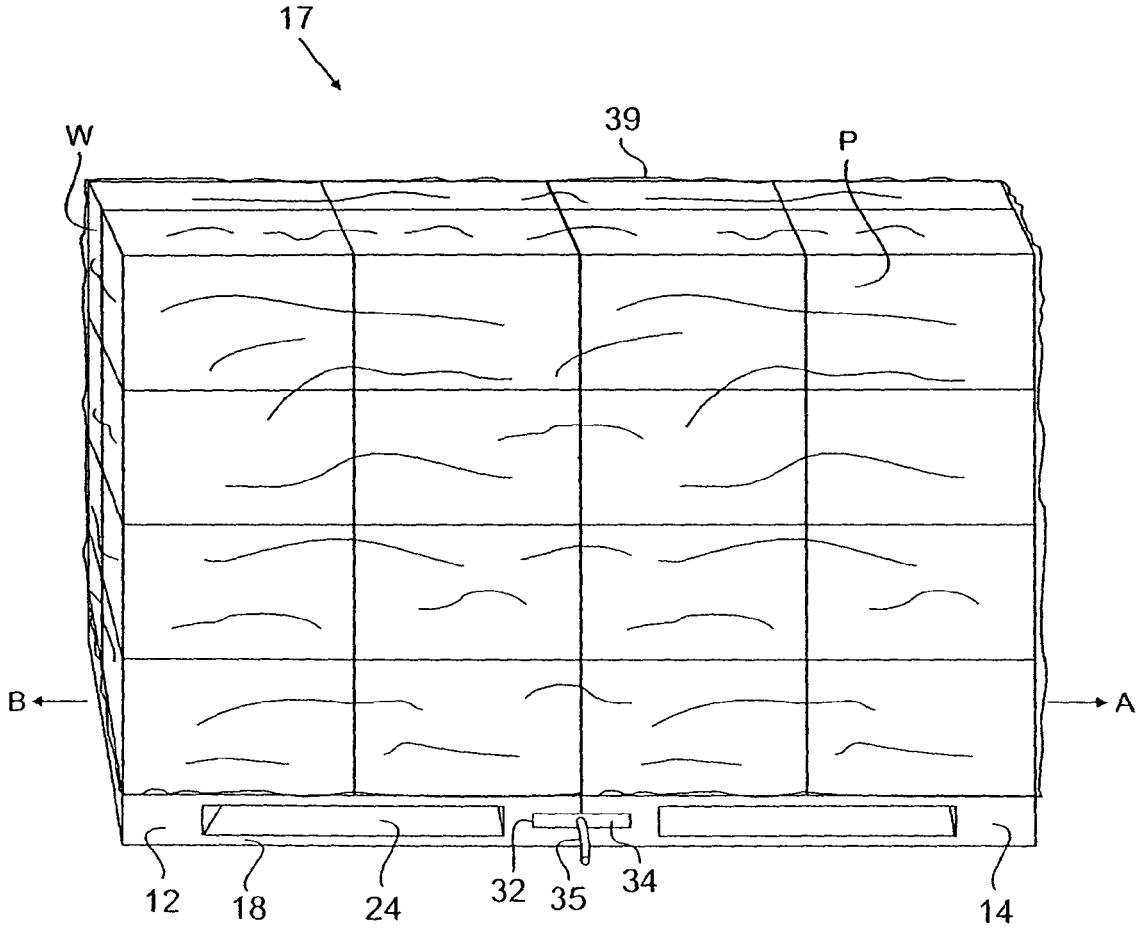
FIG. 8 is a front perspective view of products stocked on a four unit pallet, wrapped in plastic.

In use, the base plates 18 of the two unit master pallet 15 and the four unit master pallet 17 may rest on the ground, as shown in FIGS. 6, and 8, for example. The base plate 18 is optional. Lower surfaces of the blocks 20, 22 may rest directly on the ground or another layer of material (not shown) may be coupled to the blocks. The layer of material need not span the space between the blocks, as does the base plate 18. The blocks 20 and 22 may also include openings to receive forklift/handlift blades.

FIG. 5 shows a portion of a forklift 26 with blades 28 being inserted into the spaces 24 of two subpallets 12, 14 of a four unit master pallet 17. In this Figure, product P is stacked on only one of the subpallets, for ease of illustration. Products may be stacked on all or any number of the subpallets 12, 14, 12', 14'.

The plates 16, 18 and the blocks 20, 22 may comprise plywood, oriented strand board ("OSB"), corrugated cardboard, solid wood, plastic, or metal, for example. Each block 20, 22 may comprise multiple layers of material. The blocks 20, 22 may be glued to the supporting plate 16 and base plate 18 with furniture glue, for example. The blocks 20, 22 may be connected to the plates 16, 18 by other means, such as by screws, nuts, bolts, nails, etc., instead of or along with the glue. The plates 16, 18 and the blocks 20, 22 need to be of a suitable material and size to be strong enough to support the expected load on the subpallet.

The rectangular blocks 20, 22 in each subpallet 12, 14, 12', 14' may include opposing respective slots 30 to receive belts 31 to secure the products to the subpallets 12, 14, 12', 14', as shown in FIGS. 1-3 and 6, for example. The belts 31 may be plastic belts, for example. The belts may be of other materials, as well. The belts 31, which may be secured beneath the plate 16, such as on a lower surface of the plate 16, exit both slots 30 from beneath the plate 16, and are strapped around the products on the subpallet, as shown in FIG. 6, for example.

An exterior surface or sidewall 22*a* of one block, in this example, the block 22, in each subpallet 12, 14, 12', 14' includes an opening, such as a groove 32, as shown in FIGS. 1 and 4, for example). In accordance with one embodiment, in the example FIGS. 1 and 2, the grooves 32 extend along the entire length L1 of the subpallets 12, 14. In this example, the connecting plate 34 has a length CPL that is about the same as the length L1 of the grooves 32. In accordance with another embodiment of the invention, in a two unit master pallet 15, the connecting plate 34 extends at least half way across the length L1 of the subpallets 12, 14. The grooves 32 may extend at least half way across the length (and at least the same extent as the connecting plate 34), as well. The grooves 32 may extend completely across the length L1 of the subpallets even if the connecting member 34 does not. While the subpallets 12, 14 typically have the same lengths, that is not required. If the lengths are different, the connecting plate 34 is provided with a sufficient length CPL to extend at least halfway across the length of either or both pallets. The connecting plate 34 may extend at least half way along the long pallet or at least half way along the shorter pallet.

Figure 7:
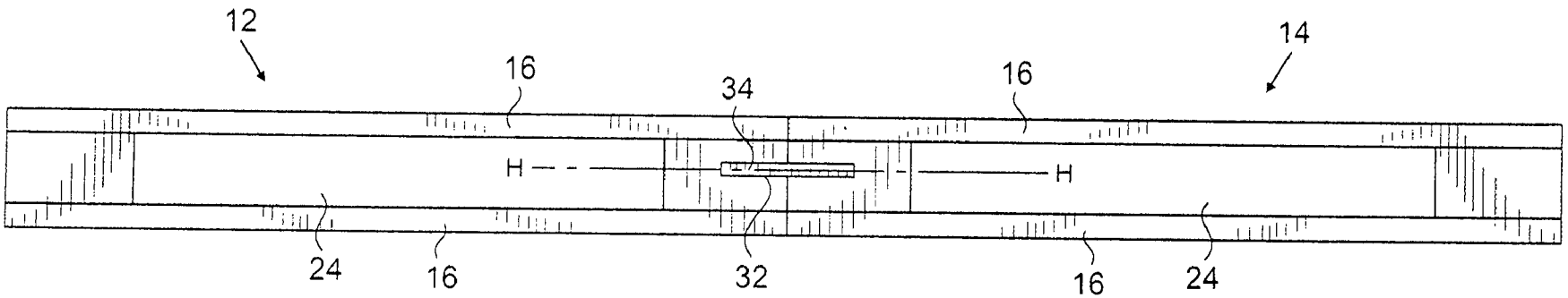
FIG. 7 is a front view of the subpallet of FIG. 2.

FIG. 7 is a front view of the subpallets 12, 14. To form the two unit master pallet 15, the subpallet 12 and the subpallet 14 are placed next to each other so that the respective sidewalls face each other and the grooves 32 are aligned in a first plane, such as a horizontal plane H, to form a larger groove, as shown in FIG. 7. The subpallets 12, 14 may be positioned so that the sidewalls are adjacent to each other, by a forklift 26 or handlift, for example. A connecting member, such as the rectangular plate 34 of FIG. 2*a*, is then slid into the opening, here the larger groove, interlocking the two subpallets 12, 14 to hold them together, as shown in FIG. 2 and FIG. 7, for example.

In the example of the four unit master pallet 17 of FIG. 3, the grooves 32 extend completely across the length L2 of the master pallet and the length CPL of the connecting plate 34 is about the same as the length L2 of the master pallet. In accordance with another embodiment, the connecting plate 34 may have a sufficient length CPL to extend completely across the first, front pallets 12, 14, and at least half way across the second, rear pallets 12', 14'. The corresponding grooves 32 extend at least half way across the lengths of the subpallets 12', 14', as well, at least as far as the connecting plate 34 will extend. They may extend across the entire length L2 of the master pallet 17, even if the connecting plate 34 does not. As above, while the subpallets 12, 14, 12', 14' typically have the same lengths L1, that is not required. If the lengths are different, the connecting plate 34 has a sufficient length CPL to extend at least halfway across the length of either or both subpallets 12', 14'. The connecting plate 34 may extend at least half way along the longer pallet or at least half way along the shorter pallet.

Each subpallet 12, 14 also comprises a front face 12*a*, 14*a* and a rear face 12*b*, 14*b*, respectively, as shown in FIG. 2. To form the four unit master pallet 17, each of the subpallets 12' and 14' are positioned by the forklift 26 or handlift so that the rear faces 12*b*, 14*b* of subpallets 12, 14 are adjacent to the front faces 12*a*, 14*a* of subpallets 12', 14', as shown in FIG. 3. The respective grooves 32 in the sidewalls of the subpallets 12', 14' also face each other in alignment in the horizontal plane H (see FIG. 7) and are also aligned with the grooves 32 of the subpallets 12, 14 in the horizontal plane H. The connecting plate 34 is then inserted into the aligned grooves 32 of the four subpallets 12, 14, 12', 14' interlocking them to form the four unit master pallet 17. The subpallets 12, 14, 12', 14' may be stacked prior to positioning to form the master pallet, or not.

The connecting plate 34 may be inserted into the groove 32 manually or by the forklift 26, or handlift for example. The connecting plate 34 may comprise wood, plywood, OSB, corrugated cardboard, metal, plastic or another material that may be selected by one skilled in the art to provide the required strength to hold the subpallets 12, 14, 12', 14' together and to support desired products or weight, as is known in the art. As shown in FIGS. 2, 2*a*, and 3, for example, a member, such as a string or rope 35, may be provided at one or both ends of the connecting plate 34, to facilitate manual removal of the connecting plate 34 by pulling on the member 35. The connecting plate 34 could thereby be removed, even if the length of the plate is less than the lengths of the grooves 32, as long as the rope or string 35 extends out of the grooves 32 or is accessible.

The groove 34 may be compressed when product is stacked on the subpallets. The height dimensions of the grooves 32 when product is stacked on a subpallet is such that the connecting plate 34 can be inserted into the grooves and fit snugly to interlock the subpallets. The height dimensions of the grooves 32 when stacked may be about the same as the height dimension of the plate. When not stacked, the height dimension of the grooves 32 may be about the same as or slightly greater than the height dimension of the plate 34.

Figure 9:
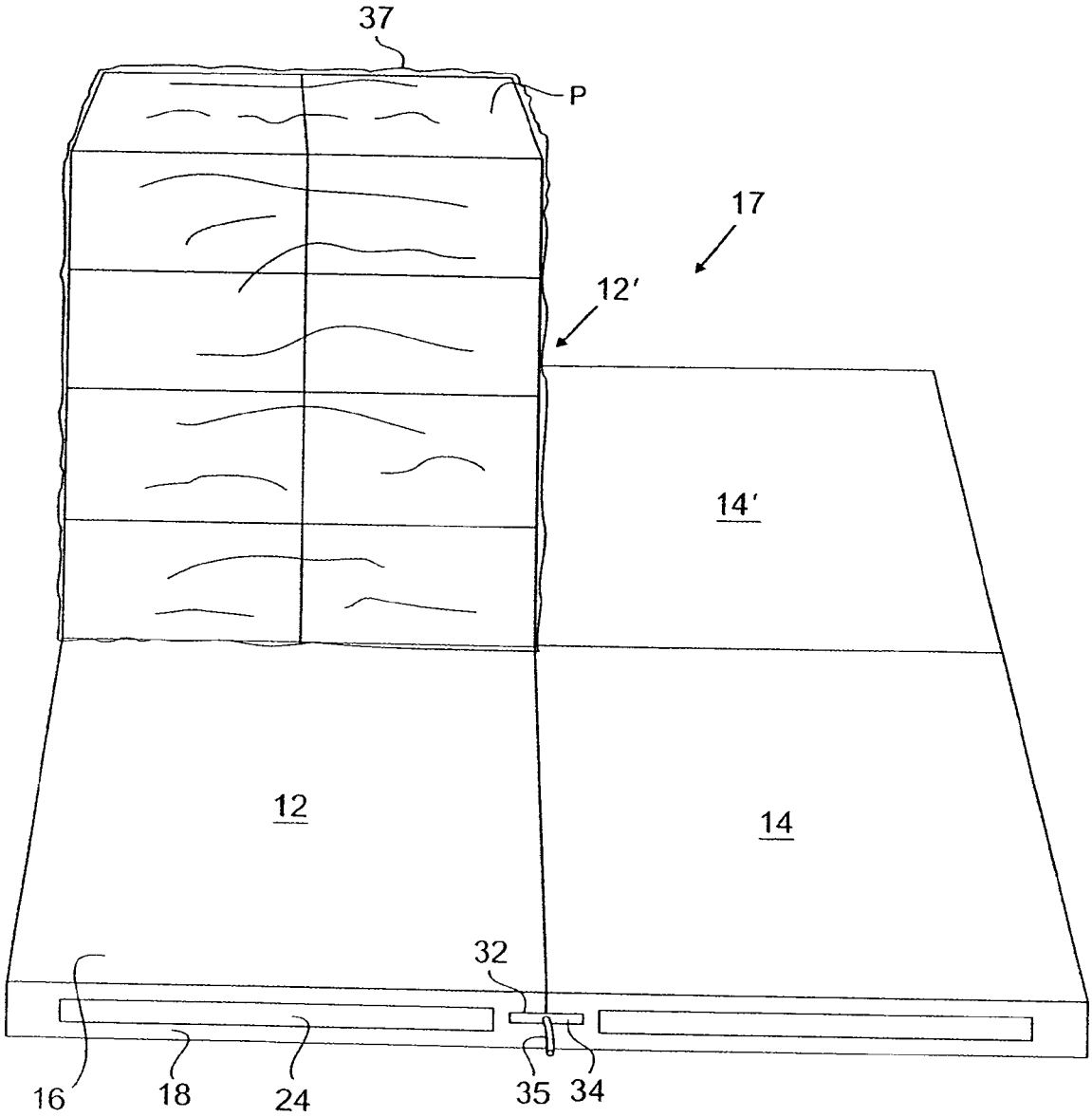
FIG. 9 is a perspective view of a four unit pallet with product stacked on one of four pallets.

In one example, products may be separately stacked on each of the two subpallets 12, 14 or four subpallets 12, 14, 12', 14'. After stacking, the products may be strapped to the respective subpallet 12, 14, 12', 14' by the belts 31, as shown in FIG. 6. Each of the stacked products on each subpallet 12, 14, 12', 14' may then be separately wrapped with plastic wrap 37, such as transparent plastic wrap from Poly-America, Grand Prairie, Tex., for example, as is known in the art. FIG. 9 also shows product P on one subpallet 12' of a four unit master pallet 17.

Plastic wrap 39 may also be wrapped around the products supported on two adjacent subpallets, such as in the two unit master pallet 15 or around the products supported on four subpallets, such as in the four unit master pallet 17, as shown in FIG. 8. Each subpallet may already be individually wrapped by plastic wrap 37. The plastic wrap 39 may be a polyethylene film, such as Blue Color Stretch Wrap Film, for example, available from Poly-America, Grand Prairie, Tex., for example. The plastic wrap 39 may include guide lines (not shown) along which the wrap may be cut to access the products stacked on the subpallets. The guide lines may be configured to facilitate opening along those lines by perforations, for example. The master pallet unit 15, 17 may then be loaded inside a container for shipping, as would a typical pallet. The same amount of product may thereby be shipped in the same containers as if traditional pallets are used. However, since the products are divided into quarters, each quarter is individually wrapped, and each quarter is supported by an individual subpallet, subdivision is facilitated.

Master pallets 15, 17 may also be assembled by positioning unstacked subpallets 12, 14 or 12, 14, 12', 14', as described above and inserting the plate 34. Then the master pallets 15, 17 may be stacked and the products wrapped in plastic, if desired.

After shipment to a warehouse, for example, the entire master pallet 15, 17 may be unloaded and stored by a forklift 26 or a handlift, as is a typical pallet. If the warehouse stores products for a store that only wants to display or unpack less than a full pallet, such as one quarter of the products typically supported on a pallet, or if the warehouse stores products for subsequent shipment to a customer that wants less than a full pallet, such as one quarter of the products typically supported on a pallet, one subpallet and the products supported on the one subpallet may be readily removed from the master pallet. The plastic wrap 39 around the entire master pallet 15, 17 may be opened or cut and one subpallet may be removed by the forklift 36 by engaging the space in one subpallet by one or more forklift blades 38 and moving the subpallet laterally away from the adjacent subpallet. Two or three subpallets may be similarly removed from the four unit master pallet 17, if desired, as well.

In the example of FIG. 8, the subpallet 14 and the products P stacked upon it can be separated from the four unit master pallet 17 by removing the plastic wrap 39, if present, and moving the subpallet 14 to the right along arrow A by the forklift 26 or handlift, to separate it from the connecting plate 34 and the adjacent subpallets 12, 12', and 14'. Since the products stacked on the subpallet 14 is also wrapped in plastic wrap W, the subpallet 14 and the stacked products may be easily moved and shipped, if desired, without rewrapping. If both pallets 12', 14' are desired, they may be removed together by the forklift 26 or handlift. If the product on the pallet 12 is desired, it may be removed by being moved to the left along arrow B in FIG. 8, by the forklift 26 or handlift.

Alternatively, subpallets 12, 12', 14, 14' may be disconnected by removing the connecting plate 34 by pulling the rope 35 at one end of the plate. The forklift 26 or handlift can then lift a desired subpallet and carry it away.

Figure 10:
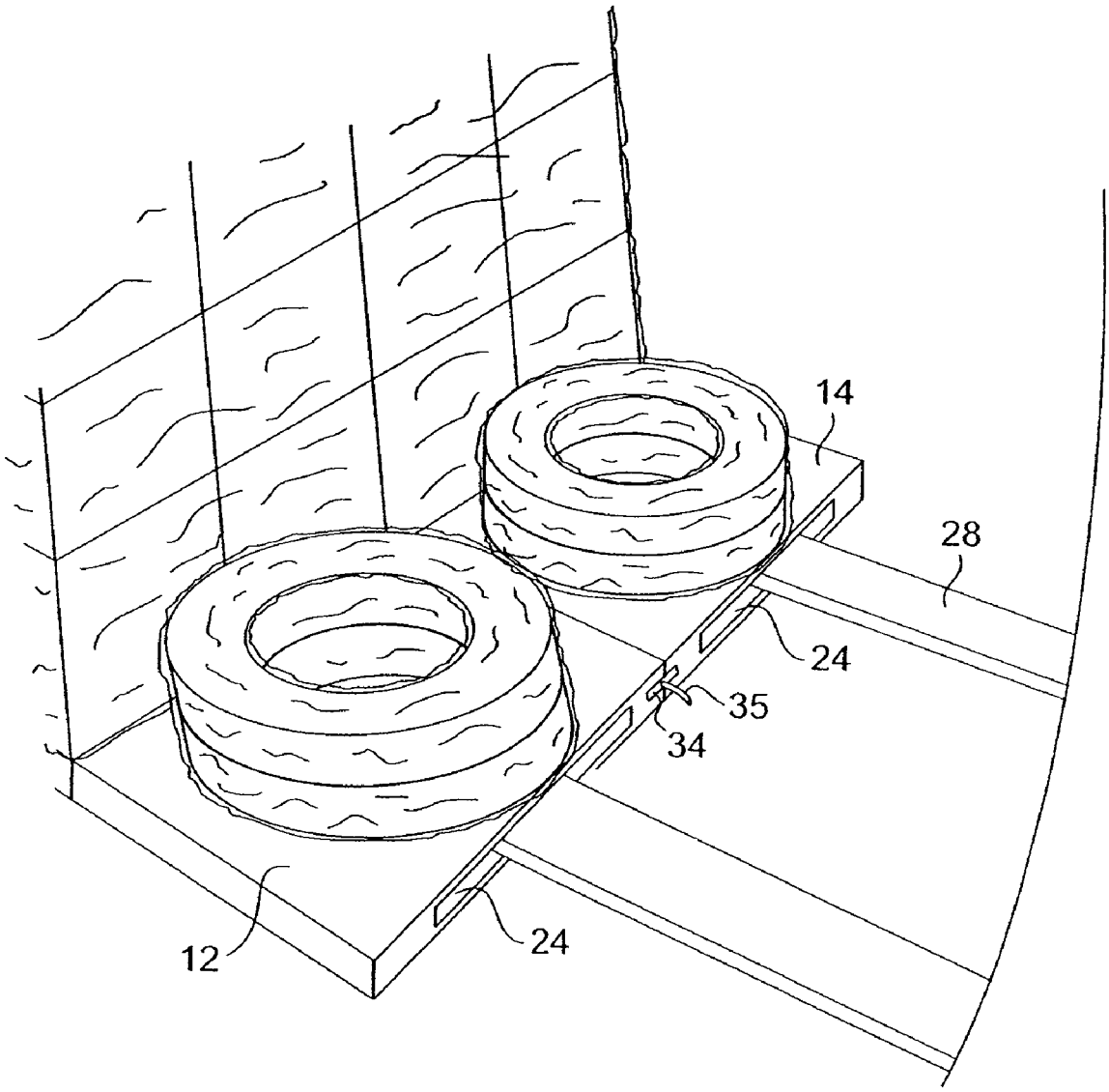
FIG. 10 is a perspective view of a four unit pallet, stacked with different products.

A master pallet 15, 17 may comprise subpallets stacked with the same products, or different products P, as shown in FIG. 10. If a customer wants four subpallets, each supporting a different product, for example, four unit master pallets 17 in a warehouse, each supporting a different product, may be separated, rearranged, and connected to form a new four unit master pallet 17, supporting the four different types of products P. The new master pallet 17 may then be rewrapped, if desired, and shipped to the customer. A four unit master pallet 17 could be created to support two or three different types of products, as well.

In one example, each subpallet 12, 14 may be 56.50 cm long (L), 46 cm wide (W), and from about 3 inches to about 4 inches (from about 7.62 cm to about 10.16 cm) thick (T), as indicated in FIG. 1. The connecting plate 46 may be 92 cm long, 7 cm wide, and 0.8 cm thick, to connect four subpallets, to form a four unit master pallet 17, for example. A master pallet 17 comprising four interlocked subpallets 12, 14, 12', 14' in this example may be 92 cm long (L2) and 113 cm wide (W). These dimensions are appropriate for stacking packages of pneumatic fasteners, bulk fasteners, and packaged fasteners, for example. The four unit master pallet 17 of these dimensions described and comprising appropriate materials of the materials described above can support from about 1,800 pounds (816 kg) to about 3,300 pounds (1,498 kg). Each subpallet can individually support at least about one quarter as much.

Figure 11:
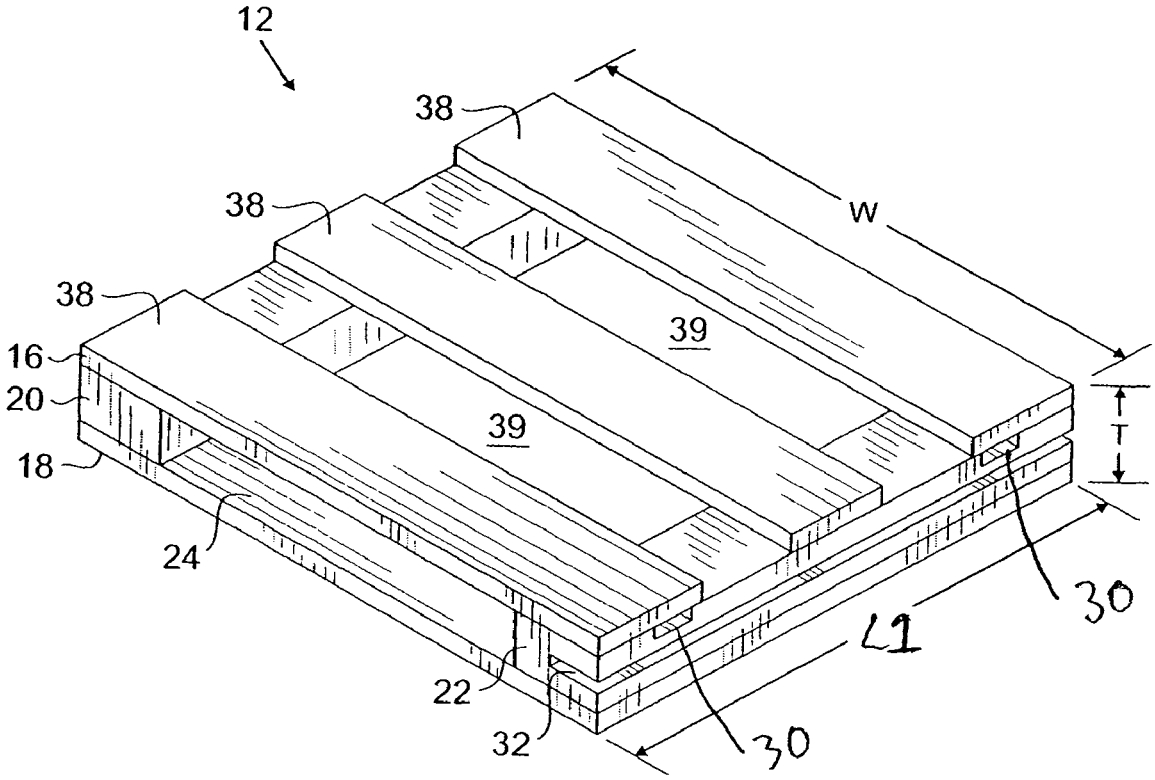
FIG. 11 is a perspective view of another example of a subpallet that may be used in embodiments of the present invention.

While in the embodiment described above, the upper and lower surfaces of the subpallets 12, 14, 12', 14' comprise plates 16, 18, respectively, either or both of the upper and lower surfaces may comprise a plurality of boards 38 of any of the materials described above, separated by spaces 39, as shown in FIG. 11.

Figure 12:
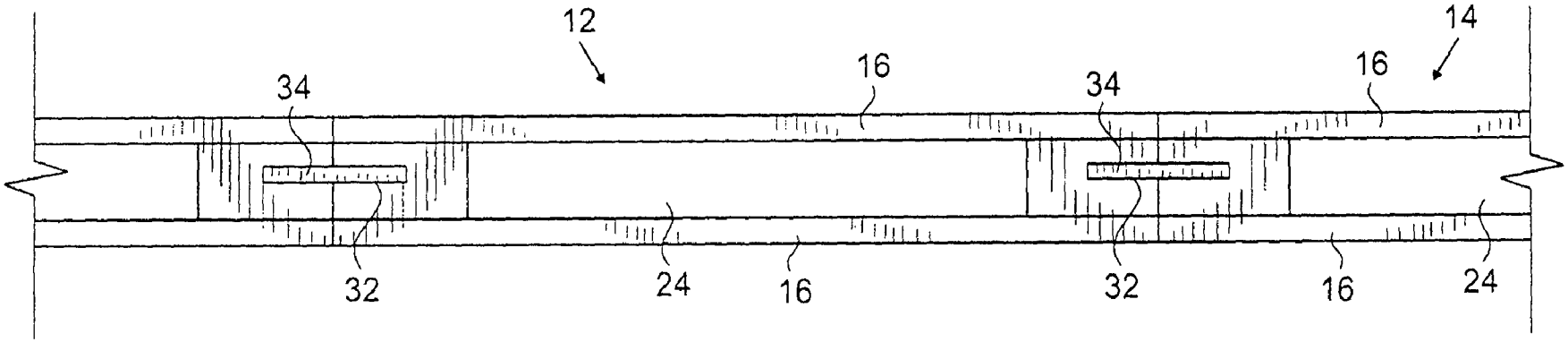
FIG. 12 is a front view of a first subpallet coupled to pallets on both sides of the first subpallet.

Master pallets of any desired size may be made. For example, subpallets and the resulting master pallet for other types of products may have different dimensions. A larger connecting plate 34 may be used for heavier products or larger pallets. Also, additional pallets may be coupled together to form larger master pallets, such as 6 unit master pallets or larger, by providing a longer connecting plate 34 to connect additional pairs of subpallets. In addition, a subpallet 12 may have grooves 34 on both blocks 20, 22, to enable connection of subpallets on both sides of the subpallet 12 by additional connecting plates 34, as shown in FIG. 12. Providing grooves 32 on both blocks 20, 22 could also facilitate the positioning of the subpallets to form the two unit master pallet 15 and the four unit master pallet 17, by avoiding the need to rotate a subpallet (subpallet 14, for example), so that the one groove 34 faces a groove of an adjacent subpallet (subpallet 12, for example).

Figure 13:
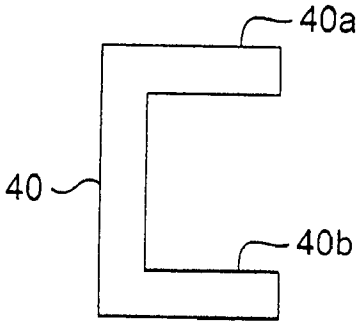
FIG. 13 is a side view of an example of a clamp that may be snapped around portions of adjacent subpallets.
Figure 14:
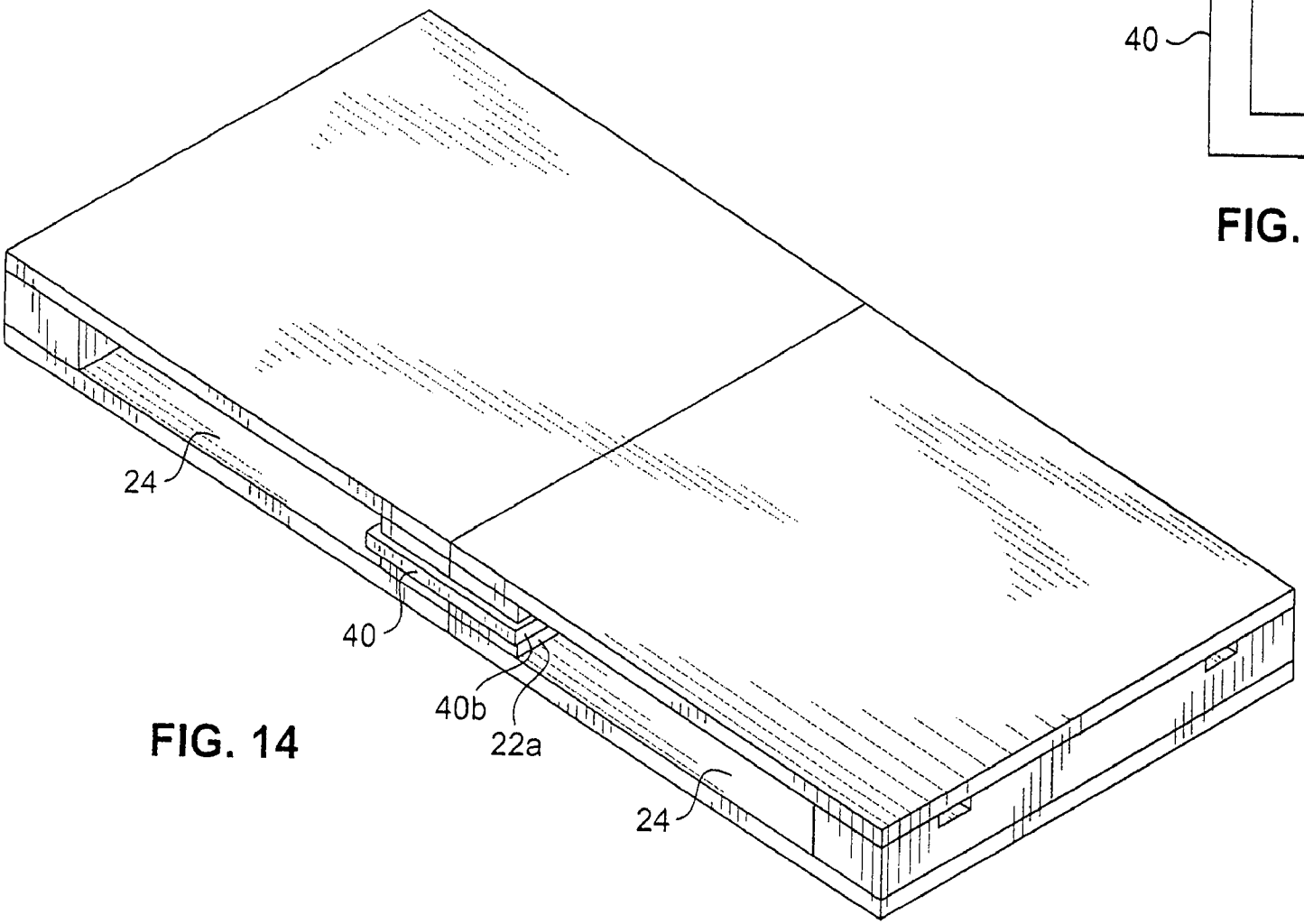
FIG. 14 is a perspective view of an example of a four unit master pallet including the clamps of FIG. 13.

FIG. 13 is a side view of U-shaped or C-shaped clamp 40 of metal or plastic, which may be snapped over the adjacent blocks 20, 22 in two subpallets, such as subpallets 12, 14, as shown in FIG. 14. The clamp 40 has two arms 40*a*, 40, each of which may extend into the spaces 24 of adjacent subpallets 12, 14, and bear against inner surfaces 22*a* of the blocks 22. In a two unit master pallet, a clamp 40 may be provided on both sides of the subpallets 12, 14. Instead of entering the spaces 24, holes may be provided in the blocks 20 to receive the arms 40*a*, 40*b* of the clamp 40. The clamp 40 may be used in addition to or instead of the connecting plate 34 and groove 32. The clamp 40 may need to be removed by a screwdriver or other such device.

Figure 15:
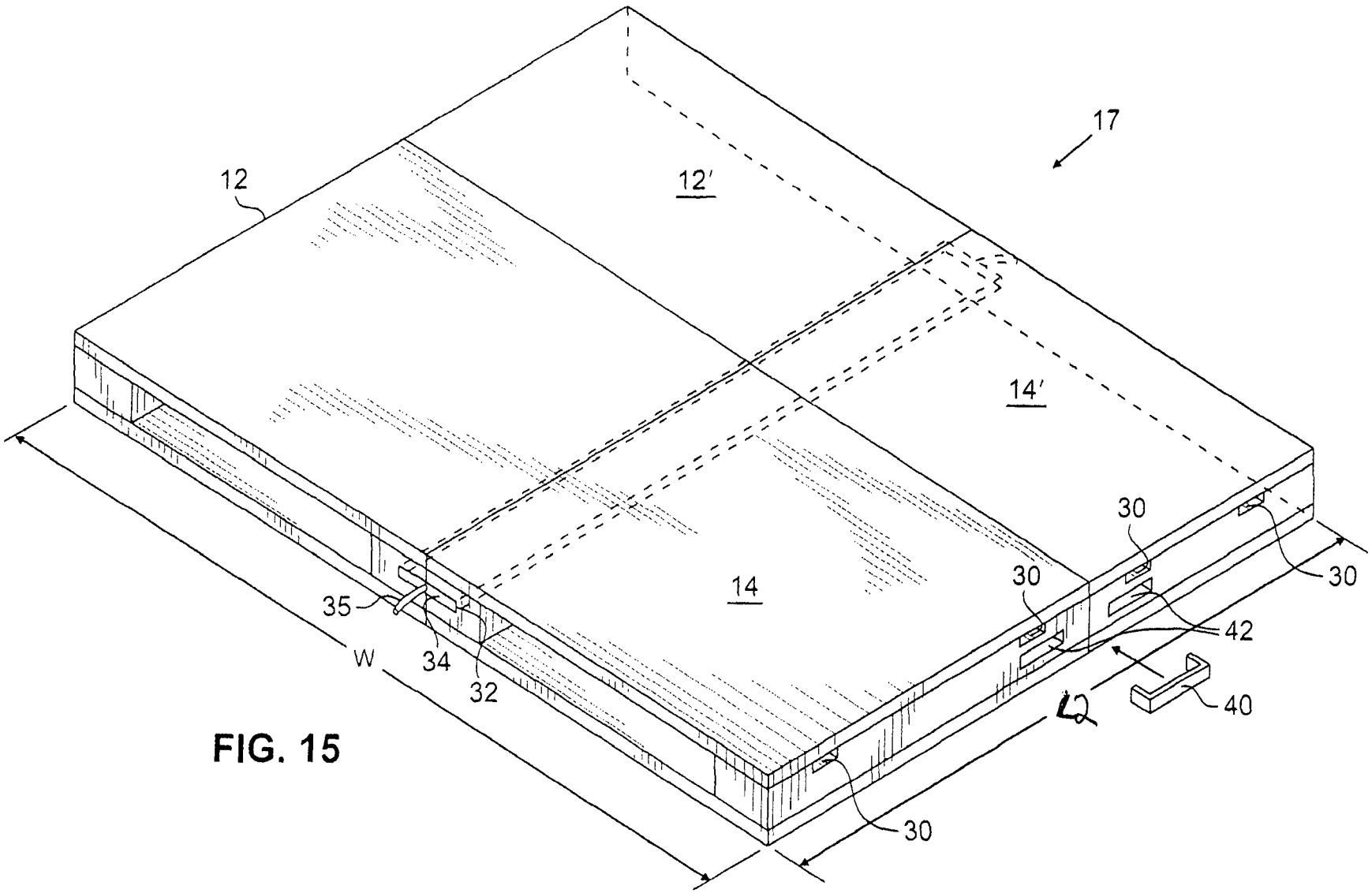
FIG. 15 is a perspective view of an example of another four unit master pallet secured by clamps received in openings in adjacent subpallets.

A four unit master pallet may be secured by clamps along with or instead of the connecting plate 34, by providing openings 42 in the blocks 20, 22, to receive additional clamps 40, as shown in FIG. 15.

Figures 16, 17:
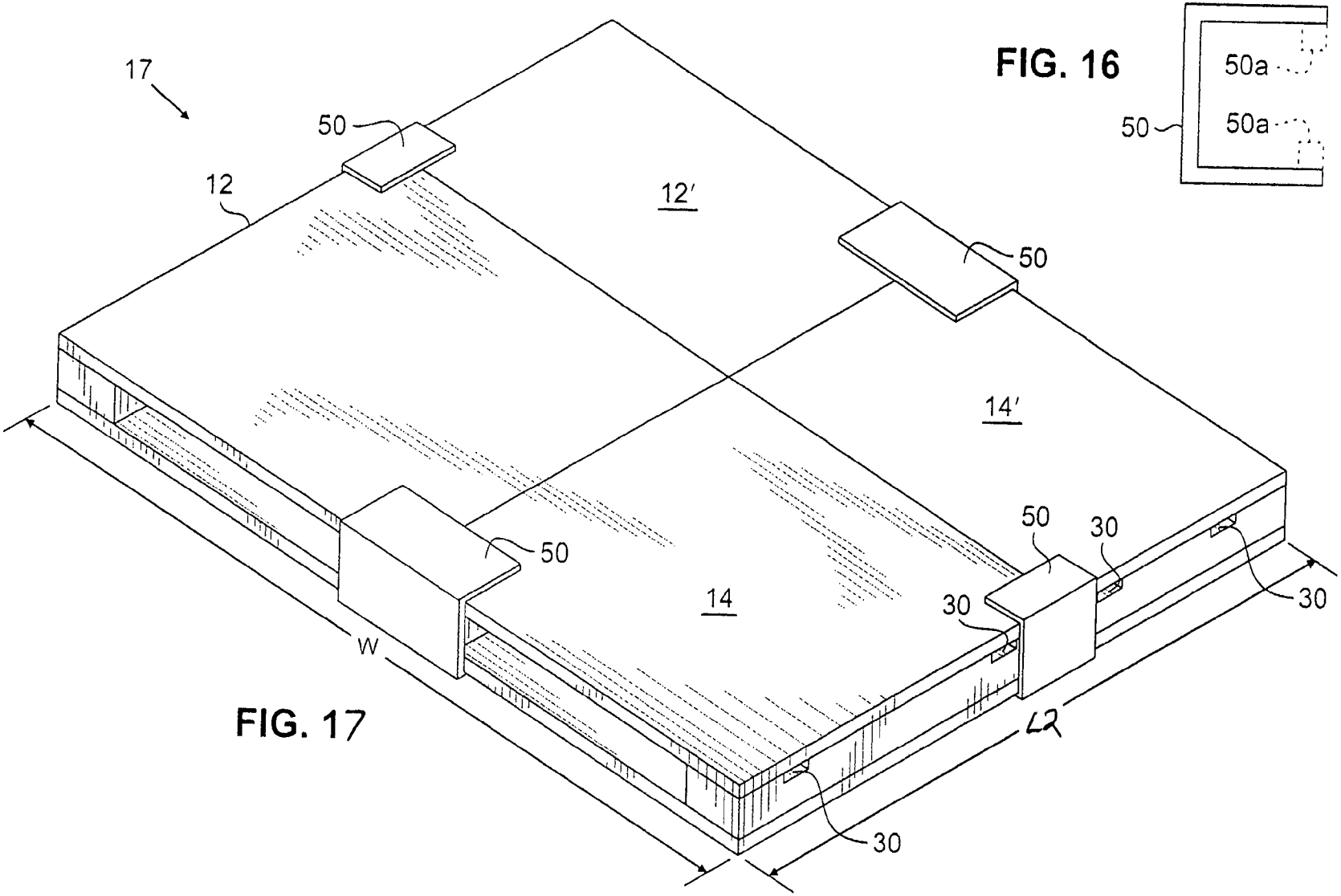
FIG. 16 is a side view of another example of a clamp or sleeve that may be fit over the top and bottom surfaces of adjacent subpallets.
FIG. 17 is a perspective view of a four unit master pallet including the sleeves of FIG. 16.

In another variation, clamps or sleeves 50 may be fit tightly over portions of the top surface of the plate 16 and the bottom surface of the plate 18 of adjacent subpallets 12, 14, 12', 14', as shown in FIGS. 16 and 17. A side view of a sleeve is shown in FIG. 16. Protrusions 50*a* (shown in phantom) may be provided at the ends of the sleeve 50 to engage openings or grooves in the plate surfaces (not shown) so that the sleeves 50 may be snap fit onto the plates. The sleeve 50 may need to be removed by a screwdriver or other such device. As above, such sleeves may be provided instead of or along with the connecting plate 34.

Other connecting mechanisms may be used, as well. For example, the connecting member may be a plurality of rods that are inserted into aligned grooves or openings through the blocks 20, 22, in a snug fit.

Changes may be made to the embodiments described herein without departing from the spirit and scope of the invention, which is defined by the claims, below.

I claim:

1. A pallet comprising:

first, second, third, and fourth pallet units, each pallet unit having a respective supporting surface comprising a front edge, a rear edge, and a first side edge extending from the front edge to the rear edge, each pallet unit further comprising a first side wall depending from the first side edge, the first side wall extending from the front edge to the rear edge;

wherein:

the first side wall of the first pallet unit is adjacent to the first side wall of the second pallet;

the first side wall of the third pallet unit is adjacent to the first side wall of the fourth pallet unit;

the rear edge of the first pallet unit is adjacent to the front edge of the third pallet unit: and the rear edge of the second pallet unit is adjacent to the front edge of the fourth pallet unit;

the first side walls of the first and second pallets each define respective first and second grooves each having open ends proximate the respective front and rear edges, the first and second grooves facing each other, being aligned with each other, and lying in a same first plane;

the first side walls of the third and fourth pallets each define respective third and fourth grooves each having open ends proximate the respective front and rear edges, the third and fourth grooves facing each other, being aligned with each other and lying in the same first plane; and an open end of the first groove being adjacent to an open end of the third groove and an open end of the second groove being adjacent to an open end of the fourth groove, such that the first, second, third and fourth grooves are aligned and lie in the same first plane;

the pallet further comprising:

a single connecting member within the entire first, second, third, and fourth grooves to connect the first, second, third, and fourth pallet units to each other, the single connecting member extending an entire length from the front edges of the first and second pallets to the rear edges of the third and fourth pallets.

2. The pallet of claim 1, wherein the first plane is a horizontal plane.

3. The pallet of claim 2, wherein the connecting member comprises a horizontally extending plate.

4. The pallet of claim 3, wherein the horizontally extending plate comprises a single flat plate.

5. The pallet of claim 4, wherein the single flat plate has the same length as the first and second lengths.

6. The pallet of claim 3, further comprising a member coupled to the plate and extending out of the first and second grooves.

7. The pallet of claim 6, wherein the member comprises a string or rope.

8. The pallet of claim 1, further comprising:

a clamp securing adjacent units together.

9. The pallet of claim 1, wherein the supporting surfaces of the first, second, third, and fourth pallet units each further comprise:

a second side edge side edge opposite the first side edge, and the a second side wall depending from the second side edge;

wherein the first and second side walls of the first, second, third, and fourth pallet units each define respective spaces to receive a respective fork of a forklift or handlift.

10. The pallet of claim 9, wherein the first, second, third, and fourth pallet units each further comprise:

a lower surface opposing the supporting surface, the lower surface being coupled to the respective first, second, and third side walls, respectively.

11. The pallet of claim 9, wherein the supporting surfaces each comprise a plurality of surfaces.

12. The pallet of claim 10, wherein the lower surfaces each comprise a plurality of surfaces.

13. The pallet of claim 1, wherein each first side is compressible by the weight of sufficient objects on the respective pallet unit, to bear against the connecting member.

14. A method of using a pallet comprising:

positioning a first pallet unit comprising a first side wall having a first groove extending completely along the first side wall adjacent to a second pallet unit comprising a second side wall having a second groove extending completely along the second side wall and facing the first groove, to align the first and second grooves;

positioning a third pallet unit comprising a third side wall having a third groove extending completely along the third side wall in front of the first pallet unit to align the third groove with the first groove;

positioning a fourth pallet unit comprising a fourth side wall having a fourth groove extending completely along the fourth side wall in front of the second pallet unit and adjacent to the third pallet unit to align the fourth groove with the second groove and the third groove, the first, second, third, and fourth grooves defining a slot with a first open end and a second open end;

inserting a single connecting member through the first open end of the slot to the second open end of the slot to connect the first, second, third, and fourth pallet units to each other, the single connecting member having a length at least as long as a length from the first open end to the second open end; and moving the connected first, second, third, and fourth pallet units to a second location.

15. The method of claim 14, further comprising:

loading at least the first pallet with a load, prior to positioning the first and second pallets.

16. The method of claim 15, further comprising securing the first load to the first pallet.

17. The method of claim 15, further comprising wrapping the load on the first pallet with plastic.

18. The method of claim 14, further comprising:

loading the first pallet with a first load;

loading the second pallet with a second load;

loading the third pallet with a third load;

loading the fourth pallet with a fourth load; and wrapping the first, second, third, and fourth loads to each other with plastic.

19. The method of claim 14, further comprising:

removing the connecting member at the second location; and moving the first pallet to a third location.

20. The method of claim 14, further comprising:

loading the first pallet with a first load comprising a first product; and loading the second pallet with a second load comprising a second product different than the first product.

21. A pallet comprising:

a first pallet unit comprising:

a first supporting surface having a first front horizontally extending edge, a first rear horizontally extending edge, and a first side horizontally extending edge having a first length extending from the front horizontally extending edge to the rear horizontally extending edge; and a first side wall depending vertically from the entire first length of the first side horizontally extending edge and having a second length the same as the first length, the first side wall having a first continuous groove lying in a plane and extending horizontally along the entire second length, the first continuous groove having an open front end at the first front horizontally extending edge and an open rear end at the first rear horizontally extending edge;

a second pallet unit comprising:

a second supporting surface having a second front horizontally extending edge, a second rear horizontally extending edge, and a second side horizontally extending edge having a second length extending from the second front horizontally extending edge to the second rear horizontally extending edge; and a second side wall depending vertically from the entire second length of the second horizontally extending edge, adjacent to the first side wall, the second side wall having a third length the same as the second length and a second continuous groove lying in the plane and extending horizontally along the entire second length, the second continuous groove having an open front end at the second front horizontally extending edge and an open rear end at the second rear horizontally extending edge, the second groove facing the first groove and being aligned with the first groove in the plane; and a third pallet unit comprising: a third supporting surface having a third front horizontally extending edge, a third rear horizontally extending edge, and a third side horizontally extending edge having a third length extending from the third front horizontally extending edge to the third rear horizontally extending edge; and a third side wall depending vertically from the entire third length of the third horizontally extending edge, the third side wall having a third continuous groove lying in a plane and extending horizontally along the entire third length, the third continuous groove having an open front end at the third front horizontally extending edge and an open rear end at the rear horizontally extending edge; and a fourth pallet unit comprising: a fourth supporting surface having a fourth front horizontally extending edge, a fourth rear horizontally extending edge, and a fourth side horizontally extending edge having a fourth length extending from the fourth front horizontally extending edge to the fourth rear horizontally extending edge; and a fourth side wall depending vertically from the fourth edge, adjacent to the third side wall, the fourth side wall having a fourth continuous groove lying in a plane and extending horizontally along the entire fourth length, the fourth continuous groove having an open front end at the fourth front horizontally extending edge and an open rear end at the fourth rear horizontally extending edge, the fourth continuous groove facing the third continuous groove and being aligned with the third continuous groove in the plane; and the third and fourth pallet units being adjacent to the first and second pallet units such that the first and third continuous grooves and the second and fourth continuous grooves are aligned in the same plane; a single connecting member being within the entire first continuous groove, the entire second continuous groove, the entire third continuous groove, and the entire fourth continuous groove, to connect the first, second, third, and fourth pallet units to each other.

* * * * *